United States Patent [19]

Davis et al.

[11] Patent Number: 4,472,473

[45] Date of Patent: Sep. 18, 1984

[54] CURVED CAP CORRUGATED SHEET

[75] Inventors: Randall C. Davis, Poquoson; Thomas T. Bales, Newport News; Dick M. Royster, Hampton; L. Robert Jackson, Newport News, all of Va.

[73] Assignee: The United States of America as represented by the Administrator of the National Aeronautics and Space Administration, Washington, D.C.

[21] Appl. No.: 510,136

[22] Filed: Jul. 1, 1983

[51] Int. Cl.[3] ..... B32B 3/28; B32B 3/30

[52] U.S. Cl. ..... 428/184; 52/814; 428/182; 428/595

[58] Field of Search ..... 428/182, 184, 186, 179, 428/181, 595, 603, 604; 156/205, 207; 52/519, 465, 561, 814, 823

[56] References Cited

U.S. PATENT DOCUMENTS 1,889,784 12/1932 Harter ..... 52/519
2,160,677 5/1939 Romanoff .
3,902,288 9/1975 Knudson .
4,084,029 4/1978 Johnson et al. .
4,144,369 3/1979 Wass ..... 428/182
4,198,018 4/1980 Brault .

*Primary Examiner*—Paul J. Thibodeau
*Attorney, Agent, or Firm*—Howard J. Osborn; John R. Manning

[57] ABSTRACT

The invention is a structure for a strong, lightweight corrugated sheet. The sheet is planar or curved and includes a plurality of corrugation segments, each segment being comprised of a generally U-shaped corrugation 12 with a part-cylindrical crown 13 and cap strip 20, and straight side walls 14 and 15 with secondary corrugations 16 oriented at right angles to said side walls. The cap strip 20 is bonded to the crown 13 and the longitudinal edge 18 of said cap strip extends beyond edge 17 at the intersection between said crown and said side walls. The high strength relative to weight of the structure makes it desirable for use in aircraft or spacecraft.

10 Claims, 9 Drawing Figures

CURVED CAP CORRUGATED SHEET

ORIGIN OF THE INVENTION

The invention described herein was made by employees of the United States Government and may be used by or for the Government for governmental purposes without the payment of any royalties thereon or therefor.

BACKGROUND OF THE INVENTION

This invention is in the general field of design of structural components. More particularly, it relates to components particularly advantageous for aircraft, spacecraft and other vehicles, which must be lightweight relative to their strength and stiffness. In further particularity, it relates to improvements in the structure and geometry of corrugated sheets.

One well known technique for achieving the aforementioned stiffness and strength relative to weight in structural components which include a sheet, is to use a corrugated sheet fabricated from suitable metals or fiber reinforced resin matrix composites. Such a sheet, instead of being flat, is corrugated with the corrugations being oriented transverse to the lengthwise dimension of the sheet. The rigidity of such a corrugated sheet may be increased by providing it with secondary corrugations extending from the side walls. The local strength and bending stiffness of corrugated sheets may be further increased by bonding separate cap strips to the main corrugations wherein the cap strips support the compressive load.

Although the aforementioned technique is well known, there is a constant need for structures with improved strength to weight relationships. For corrugated sheets constructed from composite materials, problems exist in orienting the fibers so they are appropriately spaced and not bunched in some areas and too sparsely distributed in others so that all of the fibers are relatively evenly tensioned rather than being slack or strained, resulting in local weaknesses in the corrugated sheet. Use of the aforementioned technique with diffusion bonded and superplastic formed metals or composites often results in decreased strengths and rotational stiffness due to insufficient stabilization of the edges of the main corrugations. Further, corrugated structures are highly susceptible to impact damage along the exposed edges and flat surfaces of the main corrugations. In practice, these and other deficiencies result in a loss in structural efficiency which necessitates a heavier structure for a given load and span.

Accordingly, it is an object of this invention to provide a corrugated sheet structure with improved strength and stiffness relative to weight.

Further, it is an object of the present invention to provide an improved corrugated sheet design for bearing compressive loads and for use in forming the structure of aircraft and spacecraft.

Still further, it is an object of this invention to provide an improved corrugated sheet structure fabricated from metal or fiber reinforced composites. A related object is to solve the problems inherent in providing structural components with corrugated sheets made from metal or fiber reinforced composites.

Yet another object of this invention is to provide a corrugated sheet design that is capable of being fabricated as a unitary structure with repeated corrugated segments and which has the combined characteristics of ease of repair, minimum volume displacement and ease of fabrication.

Still another object is to provide a corrugated sheet that is resistant to damage from contact at exposed edges and surfaces and has improved rotational support.

These and other objects are attained by providing a strong, lightweight corrugated sheet of a particular shape. In the preferred form, the invention comprises a plurality of elongated corrugation segments in parallel side by side adjacency and extending across the sheet. Each corrugation segment is generally U-shaped in cross-section and rigidly secured to each adjacent segment to form a sheet. Each corrugation segment includes straight side walls and top and bottom crowns which are part-cylindrical and not flat as in prior art. The side walls of each corrugation segment may be corrugated to increase the strength and rigidity of the sheet. In addition, a cap strip may be bonded to each part-cylindrical crown, and the longitudinal edges of the cap strip may be crimped down over the adjacent side wall thereby forming a flange which increases the local buckling strength and damage resistance of the corrugation segment.

BRIEF DESCRIPTION OF THE DRAWINGS

A more complete appreciation of the invention and the attendant advantages thereof will become more apparent by reference to the following description when considered in connection with the accompanying drawings, wherein.

DETAILED DESCRIPTION OF THE INVENTION

Figure 1:
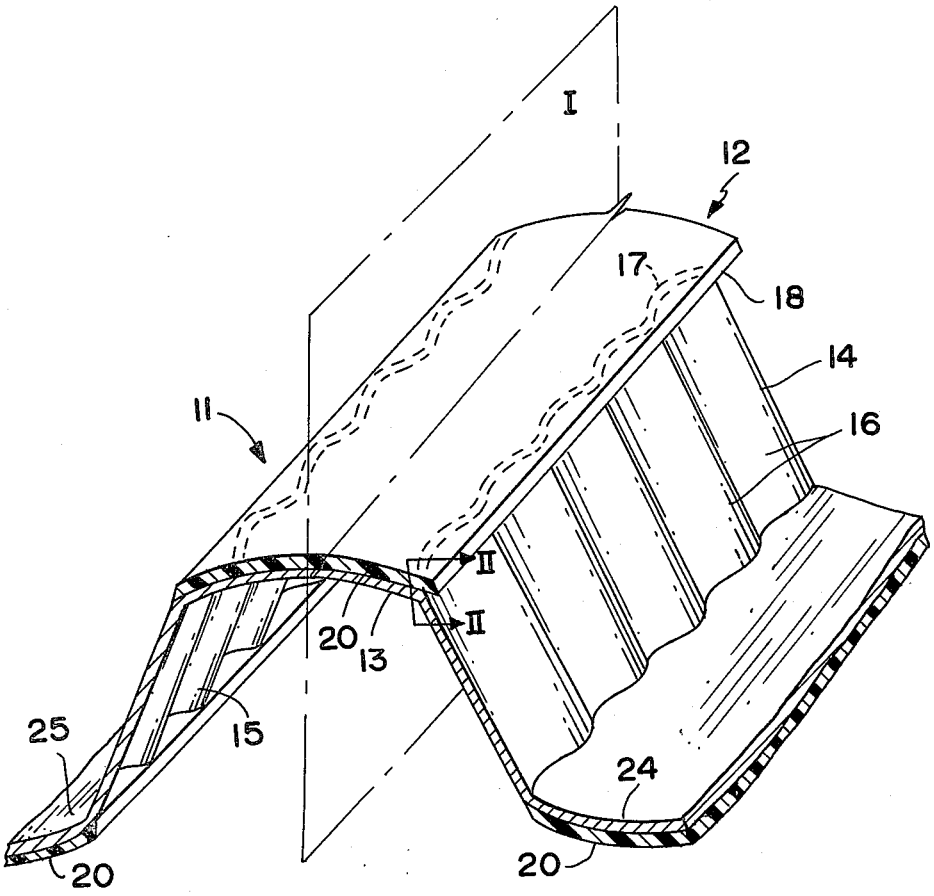
FIG. 1 is a perspective view of a corrugated sheet segment constructed in accordance with the principles of the invention.

With reference to FIG. 1, a segment of corrugated sheet incorporating the principles of the invention and designated generally by reference numeral 11 is illustrated. Although a single segment is shown, actually a plurality of similar segments are arranged in side by side adjacency to form an extended sheet or panel. The corrugated sheet segment 11 comprises a main U-shaped corrugation 12 of the desired size, shape and thickness and may be constructed of metal, fiber reinforced composite, paper, cardboard or other suitable materials. The main corrugation 12 is symmetrical about the I plane, and in practice the main corrugation 12 extends lengthwise parallel to the I plane for the desired distance.

Figure 2:
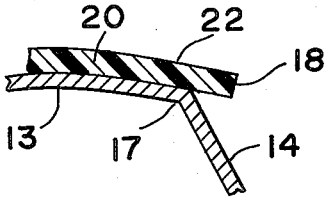
FIG. 2 is a cross-sectional view of the cap strip edge.
Figure 3:
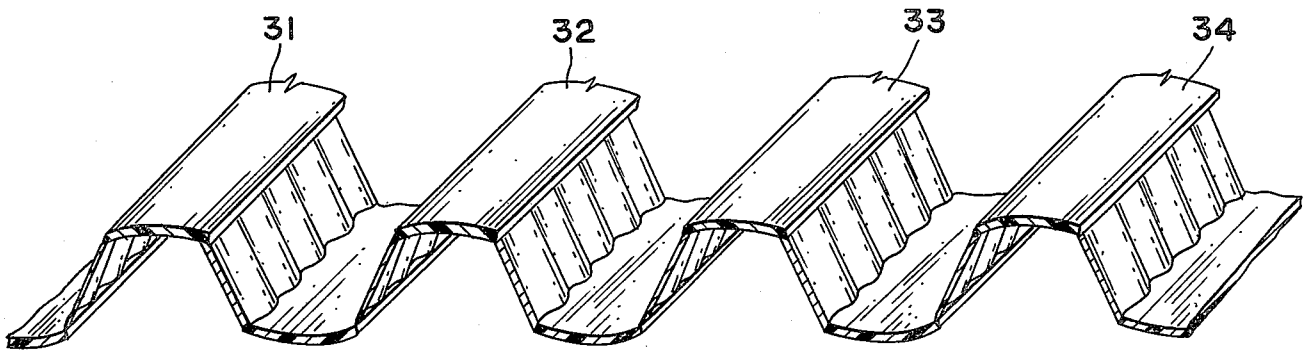
FIG. 3 is a perspective view of repeated segments of the invention corrugated sheet.

The top crown 13 of the main corrugation sheet 12 is part-cylindrical, being in this case about 10% of a cylinder, and convex, being curved outwardly from the central plane of the sheet causing the elongated crown 13 to resemble a segment from a cylinder. The expression "part-cylindrical" as used herein means that the crown is part of a circle, i.e., 90°, 180°, etc. Thus, the expression does not mean that the crown is in part cylindrical and in part noncylindrical. The part-cylindrical crown may occupy 0° to 180°, and preferably 5° to 30°, of a circle. In addition, the crown, in cross-section, may be the segment of an elipse, parabola, hyperbola or other appropriate curve, which is not flat. The side walls 14 and 15 of the main corrugation are themselves corrugated having small secondary corrugations 16 extending from the side walls. The secondary corrugations 16 may be of any suitable shape which reinforces the side walls and prevents or inhibits their buckling under load. In the illustrated embodiment said secondary corrugations 16 are sinusoidal in shape and are coterminous with the part-cylindrical crown 13, thereby forming a sinusoidal edge 17. The side walls 14 and 15 are rigidly secured to the convex bottom crowns 24 and 25 respectively, which in turn are secured to the adjacent corrugation segments, as shown in FIG. 3. Cap strips 20 of desired thickness are constructed from metal, fiber reinforced composite, paper, cardboard or other suitable material and bonded to the part-cylindrical crowns 13, 24 and 25 and curved in accordance with the curvature of the crowns. In the illustrated embodiment, the longitudinal edge 18 of the cap strip segment 20 extends beyond edge 17. More particularly, FIG. 2 shows a side view of the cap strip segment 20, wherein a portion 22 of said cap strip projects over the adjacent side wall 14, said projecting cap strip portion being about three times of the thickness of the cap strip 20.

FIG. 3 is a perspective view of repeated segments 31–34 of the invention corrugated sheet, wherein the segments are in side by side adjacency and rigidly secured to each other by convex part-cylindrical crowns to form a sheet.

Figure 4:
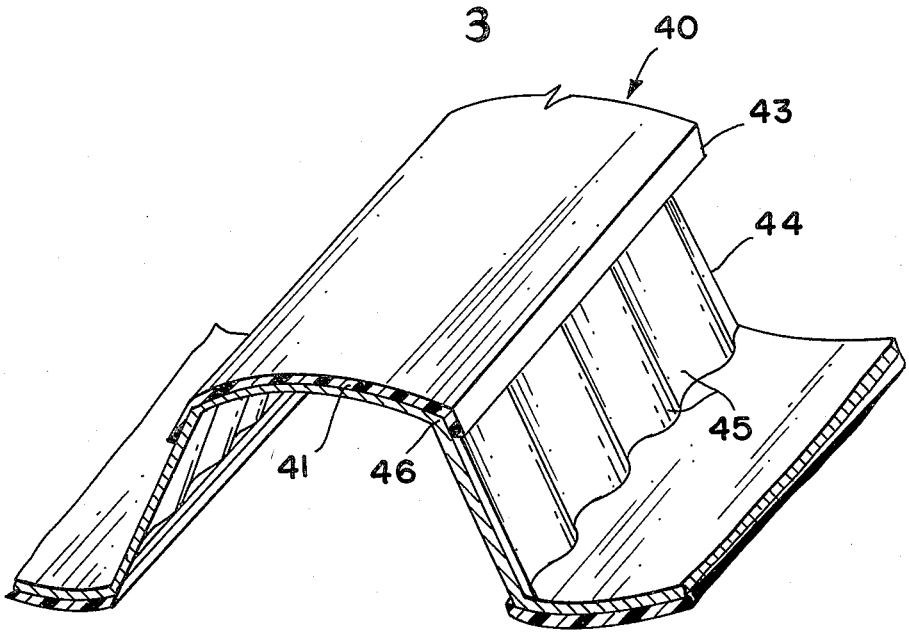
FIG. 4 is a perspective view of an alternate embodiment of the invention corrugation sheet segment wherein the cap strip is crimped over the adjacent side wall to form a flange.

FIG. 4 is a perspective view of a corrugated sheet segment 40 showing an alternate embodiment of the invention, wherein the cap strip 41 extends over edge 46 and the extended portion of the cap strip is crimped down over the adjacent side wall 44 to form a flange 43. The bottom surface of flange 43 is bonded to the adjacent side wall 44 at the crests or crowns 45 of the secondary corrugations.

Figure 5:
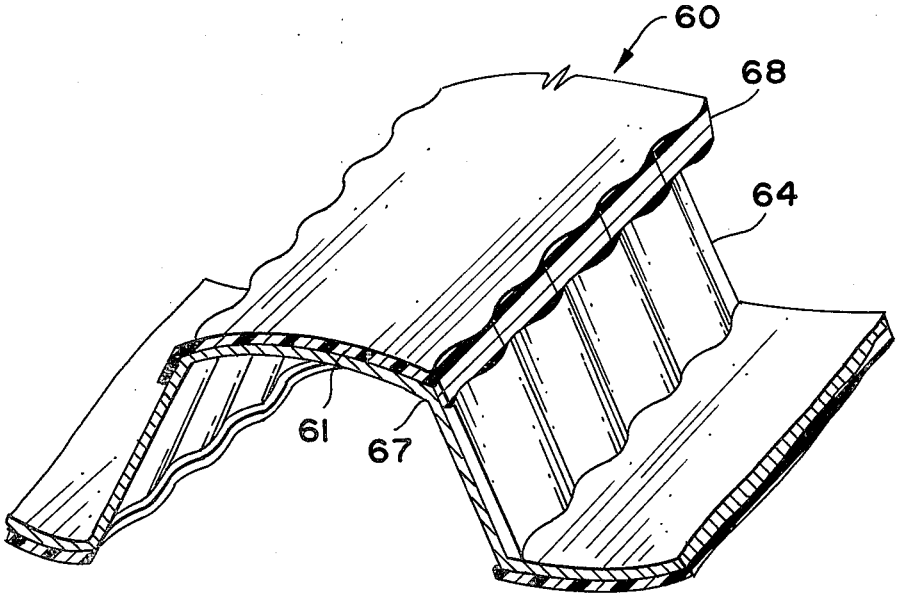
FIG. 5 is a perspective view of an alternate embodiment of the invention corrugated sheet segment wherein the flange is bonded to the adjacent side wall.

FIG. 5 is a perspective view of a corrugated sheet segment 60 where the cap strip 61 is crimped down over the adjacent side wall 64 to form a flange 68. The flange 68 is bonded to the corrugated side wall 64, thereby imparting a shape to the flange 68 corresponding to the shape of the side wall 64 and imparting an outline to edge 67 corresponding to the cross-sectional outline of the side wall 64.

Figure 6:
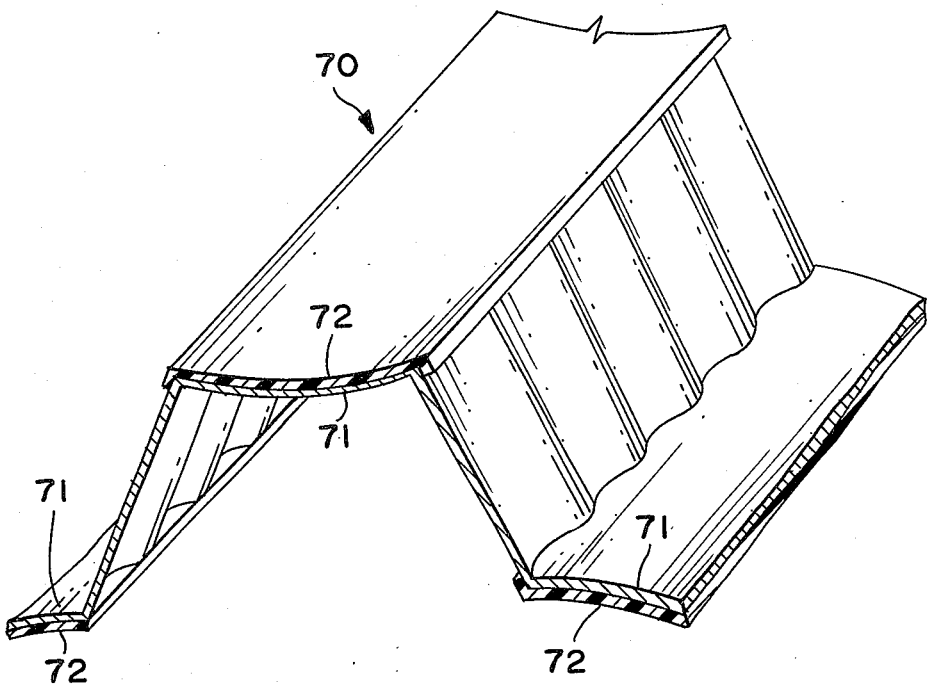
FIG. 6 is a perspective view of the invention corrugated sheet segment wherein the crown and cap strip are concave.

FIG. 6 is a perspective view of a corrugated sheet segment 70 showing an alternate embodiment of the invention with concave crowns 71 and cap strips 72.

Figure 7:
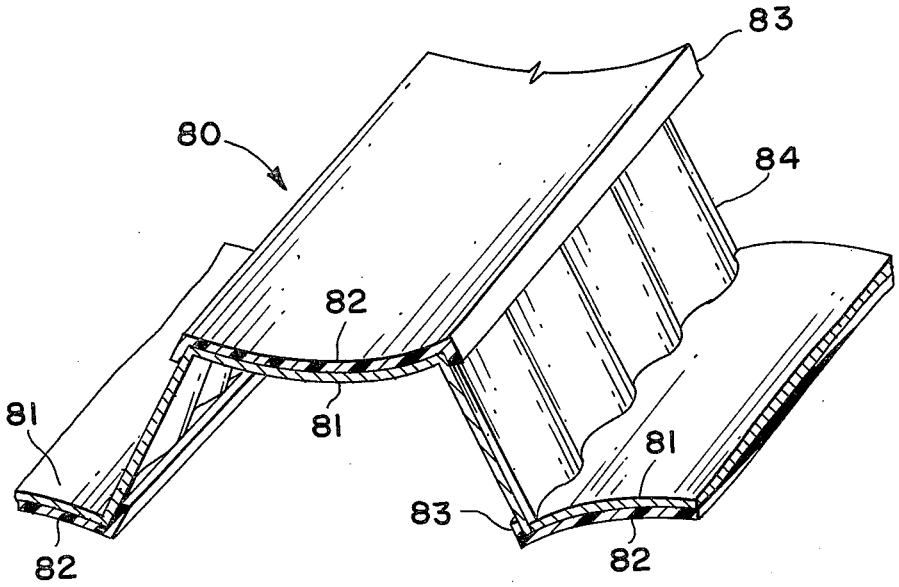
FIG. 7 is a perspective view of a corrugated sheet with concave crowns and flanged cap strips.

FIG. 7 shows a corrugation segment 80 with concave crowns 81 and cap strips 82, wherein the cap strip is crimped over the adjacent side wall 84 to form a flange 83.

Figure 8:
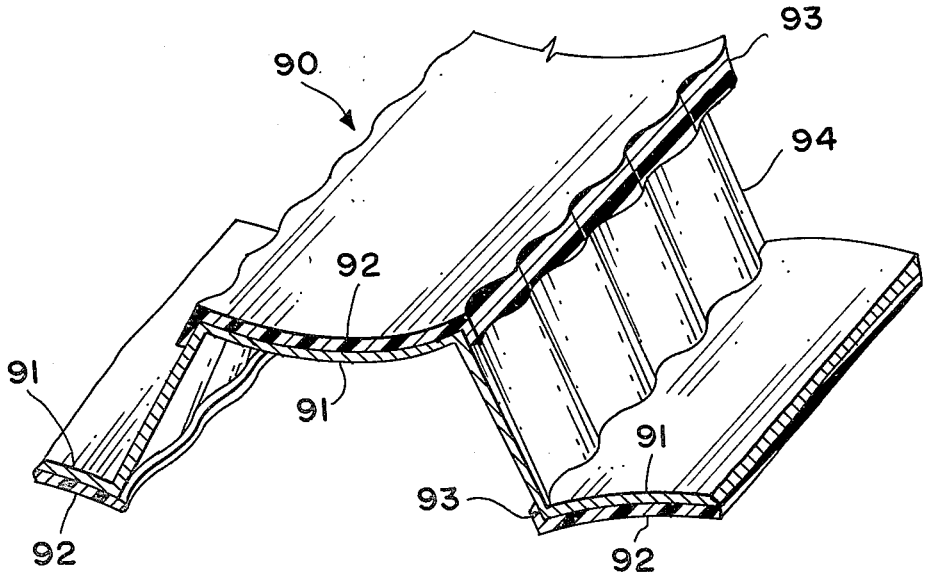
FIG. 8 is a perspective of a corrugated sheet with concave crowns and flanged cap strips, wherein the flanges are bonded to the side walls.

FIG. 8 shows an embodiment of the invention 90 with concave crowns 91 and cap strips 92 and flanges 93 which are bonded to the adjacent side wall 94.

OPERATION OF THE INVENTION

The operation of the present invention is now believed apparent. The curvature added to the crown of the main corrugation and the associated cap strip increases the local and overall strength of the sheet. In general, the part-cylindrical crown improves the bending stiffness of the main corrugation by distributing the material at a greater distance from the neutral axis. In addition, the curvature decreases the size and alters the orientation of the local buckling pattern resulting in increased strength. The part-cylindrical crown is also more resistant to impact damage than a flat crown.

Attaching the cap strips to the crown of the corrugation segment over the depth of the secondary corrugations adds to the rotational stiffness at the intersection between the crown and the side wall. In addition, crimping the cap strip edge over the side wall to form a flange prevents buckling due to local weaknesses in the sheet and prevents damage from contact with exposed edges thereby increasing the rotational support and increasing the local buckling strength. Bonding the flange to the side wall further increases the rotational stiffness and local buckling strength, and provides a structure easily fabricated by diffusion bonding.

A concave crown and cap strip achieves the same increase in local and overall strength as the convex configuration. In addition, the concave curvature of the crown and cap strip reduces susceptibility to damage from contact with exposed surfaces and reduces the overall volume displacement of the sheet.

Figure 9:
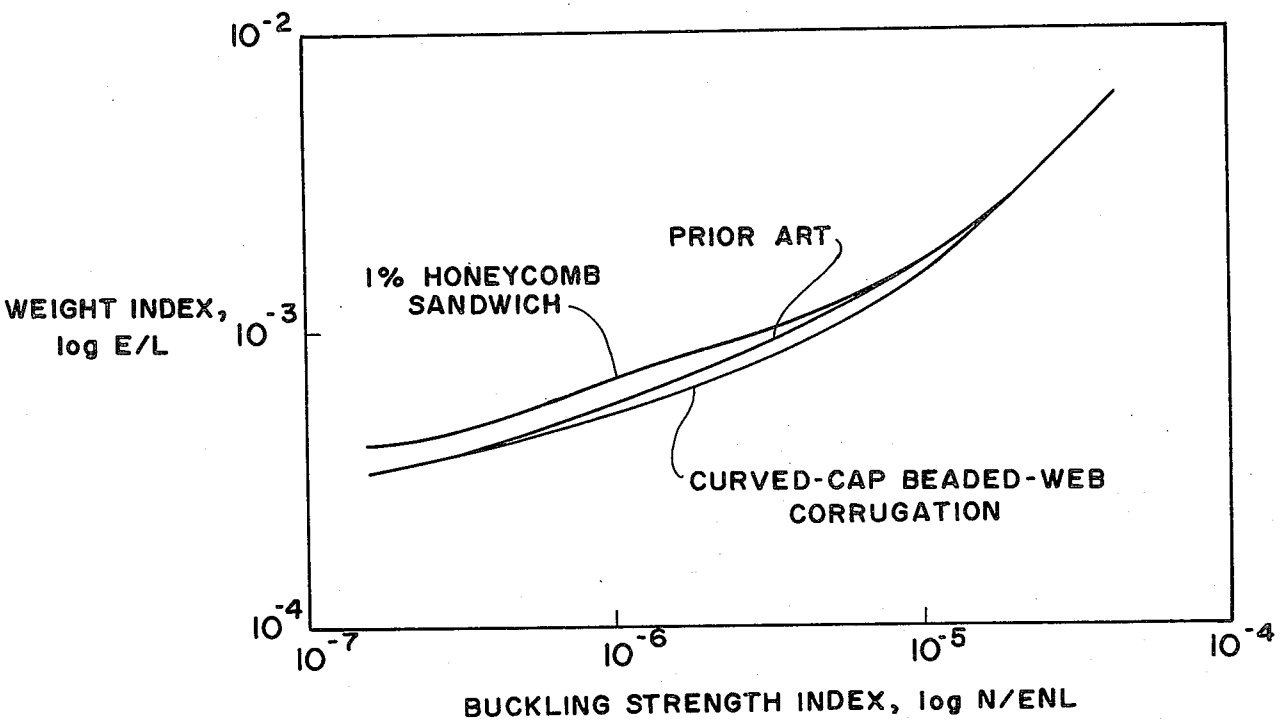
FIG. 9 is a log-log plot of weight index versus strength index comparing the invention corrugated sheet with prior art corrugated sheets.

FIG. 9 shows a log-log plot of strength index against weight index comparing the invention with prior art corrugated sheets. The strength index N/EnL is determined for a panel of modulus E and plasticity factor n transferring a compressive load per unit width N over a span L. The weight index t/L represents the weight of a panel with mass-equivalent thickness t and length L. The most efficient structure will have the lowest value of t/l for a given load. FIG. 9 indicates that the invention corrugated sheet illustrated in FIG. 1 has a structural efficiency as much as 20% greater than the prior art flat cap corrugated sheets for a wide range of practical loading.

In the light of this disclosure, it is evident that the present invention solves problems previously experienced in the design of corrugated sheets. Further, the concept allows for adequate design flexibility such that the invention is adaptable to a wide range of design applications by varying several factors, including shape, thickness and cap strip shapes and dimensions.

What is claimed as new and desired to be secured by Letters Patent of the United States is:

1. A strong, lightweight corrugated sheet comprising:

a sheet comprised of a plurality of corrugated members, said members having sidewalls which are themselves corrugated;

said corrugated members further being composed of alternate top crown means and bottom crown means which tie the sidewalls together to form the sheet;

each of said sidewalls having upper and lower edges intersecting at an angle with the adjacent top crown means and bottom crown means and being rigidly secured therealong;

said top and bottom crown means being part-cylindrical thereby forming an arcuate structure to strengthen the corrugated sheet in a direction generally transverse to the direction of the corrugated sidewalls.

2. A strong, lightweight corrugated sheet as in claim 1, wherein said part-cylindrical top and bottom crown means are concave, being curved inwardly toward the central plane of the sheet.

3. A strong, lightweight corrugated sheet as in claim 1, wherein said part-cylindrical top and bottom crown means are convex, being curved outwardly from the central plane of the sheet.

4. A strong, lightweight corrugated sheet as in claim 1 having elongated cap strips bonded to the outermost surfaces of said top and bottom crown means; said cap strips being part-cylindrical and curved in accordance with the curvature of said crowns.

5. A strong, lightweight corrugated sheet as in claim 4, wherein said elongated cap strips are coextensive with said top and bottom crown means, thereby covering the entire outer surface of each crown means and terminating at the intersection between said crown means and the adjacent side wall.

6. A strong, lightweight corrugated sheet as in claim 3 wherein said sidewalls are coterminous with said top and bottom crown, means thereby imparting an outline to the intersection of the crown means with the side walls corresponding to the cross-sectional outline of its corrugations.

7. A strong, lightweight corrugated sheet as in claim 6 having sinusoidal sidewall corrugations.

8. A strong, lightweight corrugated sheet as in claim 6 having cap strips of longer arc length, wherein the longitudinal edge of each cap strip projects beyond the intersection between the associated crown means and the corrugated side wall.

9. A strong, lightweight corrugated sheet as in claim 8, wherein each extended longitudinal cap strip portion is crimped down against the adjacent side wall thereby forming a planar flange with a straight elongated edge; said flange being bonded to the adjacent corrugated side wall at the edges of the sidewall corrugations.

10. A strong, lightweight corrugated sheet as in claim 9, wherein said flange is bonded to the adjacent corrugated side wall, thereby imparting a shape to said flange corresponding to the shape of said wall and imparting an outline to the flange edge corresponding to the cross-sectional outline of the sidewall corrugations.

* * * * *